US005980071A

United States Patent [19]

Hsieh

[11] Patent Number: 5,980,071

[45] Date of Patent: Nov. 9, 1999

[54] LIGHTING FITTING

[76] Inventor: Duan-Cheng Hsieh, 2F, No. 21, Lane 78, Huai-Te St., Pei-Tou Dist., Taipei, Taiwan

[21] Appl. No.: 09/012,362

[22] Filed: Jan. 23, 1998

[30] Foreign Application Priority Data

Oct. 17, 1997 [TW] Taiwan ..... 86217586

[51] Int. Cl.[6] ..... F21V 7/00; F21V 19/00

[52] U.S. Cl. ..... 362/454; 362/249; 362/408

[58] Field of Search ..... 362/227, 404, 362/408, 457, 249

[56] References Cited

U.S. PATENT DOCUMENTS

| | | | |
|---|---|---|---|
| 1,484,978 | 2/1924 | Wheeler | 362/249 X |
| 2,914,661 | 11/1959 | Winkler | 362/408 X |
| 4,118,764 | 10/1978 | Bleiweiss et al. | 362/249 X |
| 4,300,190 | 11/1981 | Mershon | 362/404 |
| 4,356,540 | 10/1982 | Goralnik | 362/249 X |
| 4,956,758 | 9/1990 | Aubrey et al. | 362/457 X |
| 5,174,648 | 12/1992 | Clary et al. | 362/404 X |

*Primary Examiner*—Laura K. Tso

*Attorney, Agent, or Firm*—Skjerven, Morrill, MacPherson, Franklin & Friel LLP; Alan H. MacPherson; Elaine H. Lo

[57] ABSTRACT

A lighting fitting for an incandescent lighting arrangement with a pair of incandescent bulbs, includes a lampshade body and a mounting bracket. The lampshade body is formed from molding plastics, and has an upper wall that defines a central through hole, and a skirt portion that extends downwardly and divergently from the periphery defining the upper wall. The mounting bracket includes an elongated middle portion which is formed with a mounting hole aligned with the through hole, and which has a distal wide surface and a proximate wide surface relative to the upper wall, and first and second end portions which are in line with and disposed at opposite ends of the middle portion. The first and second end portions are bent to an acute angle relative to and toward the distal wide surface of the middle portion along two parallel lines which incline at a predetermined angle relative to a vertical line that crosses a longitudinal direction of the middle portion so as to form first and second anchoring surfaces. The first and second anchoring surfaces respectively face two opposite inner surfaces of the skirt portion. The incandescent bulbs respectively have a bulb base fixed on the respective anchoring surface.

5 Claims, 4 Drawing Sheets

LIGHTING FITTING

BACKGROUND OF THE INVENTION

1. Field of the Invention

The invention relates to a lighting fitting, more particularly to a lighting fitting for an incandescent lighting arrangement which has a pair of incandescent bulbs.

2. Description of the Related Art

A conventional lighting fitting includes a lampshade body of molding plastics, amounting bracket, a socket member, a pair of insulated conductive cord members, a containment member, a power cord member, and an incandescent bulb. The incandescent bulb has a bulb body and a bulb base. The lampshade body has an upper wall with a through hole formed therethrough, and a skirt portion which extends downwardly and divergently from the periphery confining the upper wall. The mounting bracket is fixed to the upper wall, and has a mounting hole aligned with the through hole of the upper wall, and a mounting face distal relative to the upper wall. The socket member has a shell portion to receive the bulb base, and a seat portion which extends from the shell portion in an axial direction and which is disposed perpendicularly to abut against the mounting face of the bracket member. The insulated conductive cord members have first ends connected conductively to the seat portion of the bulb body, and second ends that extend through the mounting hole of the bracket member and the through hole of the upper wall to form a first contact terminal. The second ends of the insulated cord members are disposed outwardly and upwardly relative to the lampshade body. The containment member is capable of housing electrical components associated with the supply of electricity to the incandescent lighting arrangement, and includes a circumferential wall superimposed upon the upper wall of the lampshade body when the containment member is coupled with the lampshade body. The power cord member is adapted to be connected to a power supply and is led downwardly and outwardly of the circumferential wall of the containment member to form a second contact terminal for coupling conductively with the first contact terminal.

Note that the incandescent bulb extends downwardly and vertically relative to the bracket member in the conventional lighting fitting. The lighting effect provided thereby is inferior to a halogen lamp which has the same wattage as the incandescent bulb, thereby resulting in discomfort to a user who is accustomed to the lighting arrangement of the halogen lamp.

SUMMARY OF THE INVENTION

Therefore, the object of this invention is to provide a lighting fitting for an incandescent lighting arrangement that includes a pair of incandescent bulbs and that can provide lighting arrangement comparable to that of a halogen lamp which has the same wattage as the incandescent bulbs.

Accordingly, the lighting fitting of this invention is adapted for an incandescent lighting arrangement with a pair of incandescent bulbs, and includes a lampshade body, a mounting bracket, a pair of socket members, a pair of insulated conductive cord members, a containment member, and a power cord member. The lampshade body is formed from molding plastics, and has an upper wall that defines a through hole in a center thereof, and a skirt portion that extends downwardly and divergently from the periphery defining the upper wall. The mounting bracket includes an elongated middle portion which is formed with a mounting hole that is aligned with the through hole of the upper wall and which has a distal wide surface and a proximate wide surface relative to the upper wall, and first and second end portions which are in line with and disposed at opposite ends of the middle portion. The first and second end portions are bent to an acute angle relative to and toward the distal wide surface of the middle portion along two parallel lines which incline at a predetermined angle relative to a vertical line that crosses a longitudinal direction of the middle portion so as to form first and second anchoring surfaces. The first and second anchoring surfaces respectively face two opposite inner surfaces of the skirt portion. Each of the socket members has a shell portion adapted to receive the bulb base of one of the incandescent bulbs, and a seat portion which extend from the shell portion in an axial direction and which is disposed to abut against one of the first and second anchoring surfaces with the axial direction normal relative to the respective inner surface of the skirt portion. Each of the insulated conductive cord members has one end portion connected conductively to the seat portion of the socket member, and the other end portion led through the mounting hole of the middle portion and the through hole of the upper wall to form a first contact terminal. The first contact terminal is disposed upwardly and outwardly relative to the lampshade body. The containment member is capable of housing electrical components that are associated with the supply of electricity to the incandescent lighting arrangement, and includes an upper body which has a circumferential wall and an annular portion extending downwardly from the circumferential wall and of a dimension to shield the upper wall when the containment member is coupled with the upper wall of the lampshade body. The power cord member is adapted to be connected to a power supply and is led downwardly and outwardly of the upper body and into the annular portion to form a second contact terminal which is coupled electrically with the first contact terminal.

BRIEF DESCRIPTION OF THE DRAWINGS

Other features and advantages of this invention will become more apparent in the following detailed description of the preferred embodiment with reference to the accompanying drawings, in which.

DETAILED DESCRIPTION OF THE PREFERRED EMBODIMENT

Figure 1:
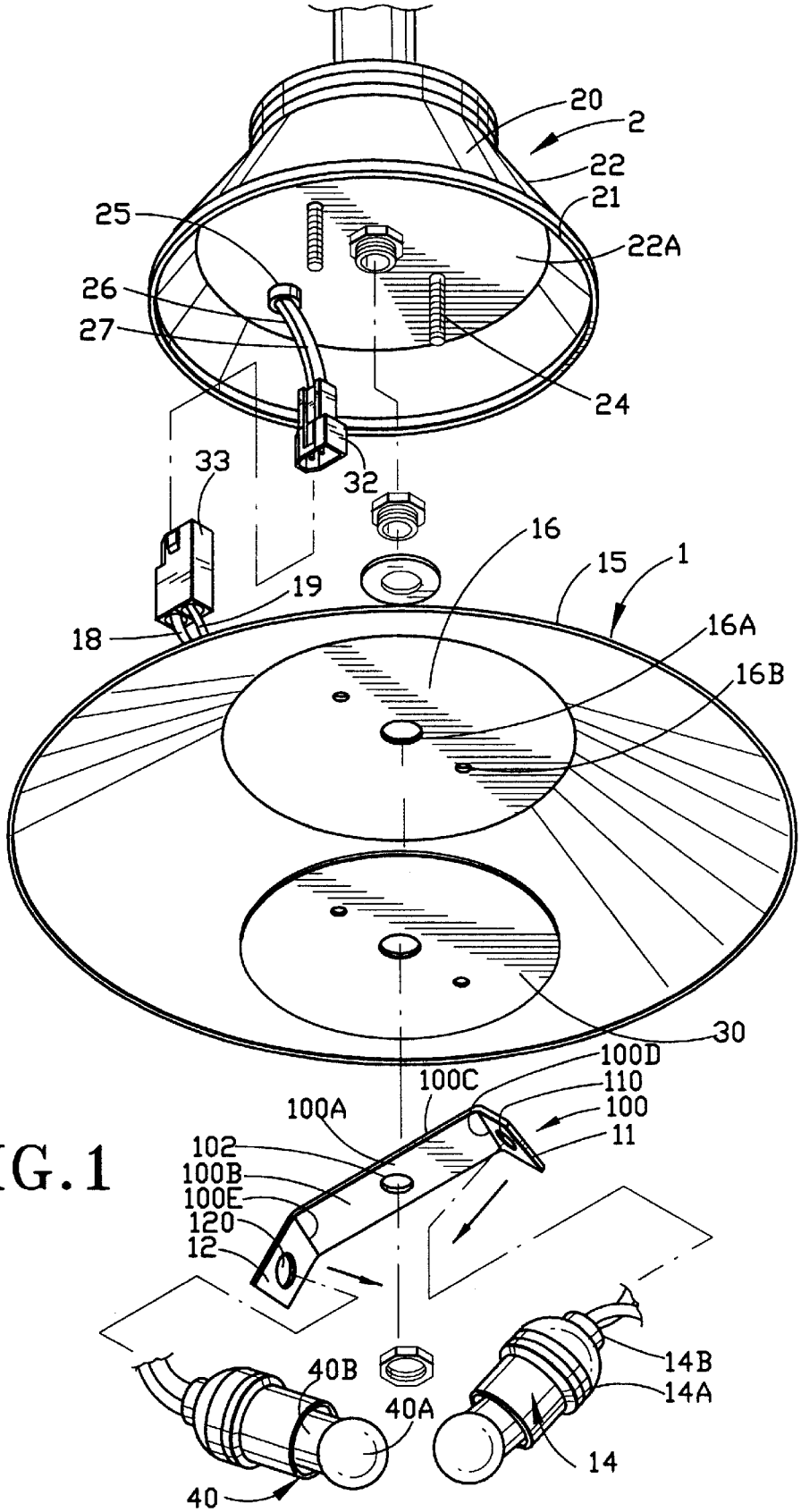
FIG. 1 is an exploded view of the preferred embodiment of a lighting fitting of this invention for an incandescent lighting arrangement.
Figure 2:
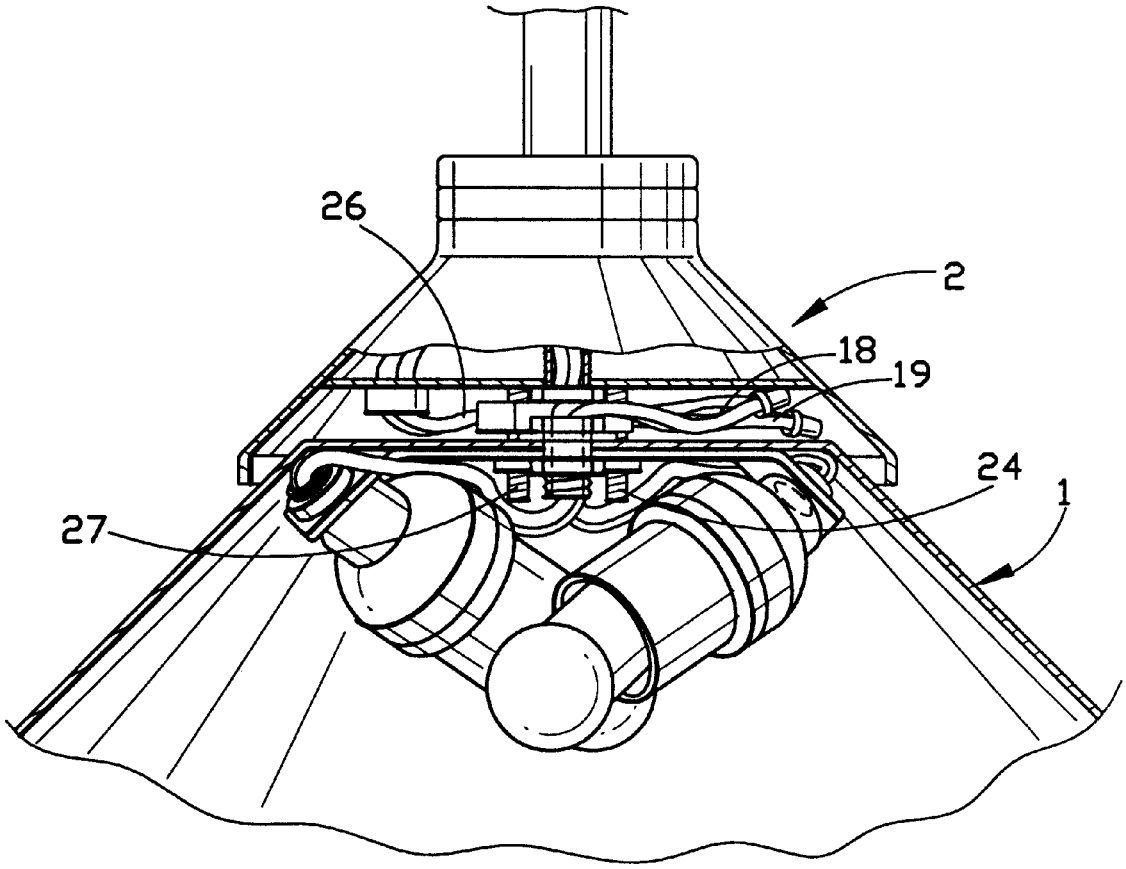
FIG. 2 is a partly sectional view of the preferred embodiment.

Referring to FIGS. 1 and 2, the preferred embodiment of a lighting fitting of this invention for an incandescent lighting arrangement is shown to include a pair of incandescent bulbs 40, a lampshade body 1, a mounting bracket 100, a pair of socket members 14, a pair of insulated conductive cord members 18, 19, a containment member 2, and a power cord member. Each of the incandescent bulbs 40 has a bulb body 40A and a bulb base 40B.

As illustrated, the lampshade body 1 is formed from molding plastics, and has an annular upper wall 16 that defines a through hole 16A in a center thereof, and a skirt portion 15 that extends downwardly and divergently from the periphery confining the upper wall 16.

Figure 3:
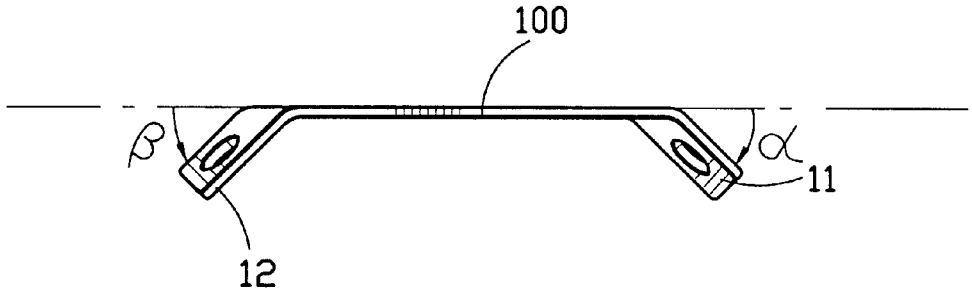
FIGS. 3 and 4 illustrate two different views of a bracket member of the preferred embodiment.
Figure 4:
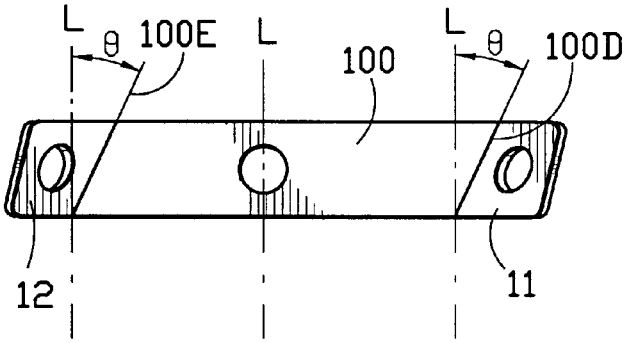

The mounting bracket 100 includes an elongated middle portion 100A which is formed with a mounting hole 102 that is aligned with the through hole 16A of the upper wall 16,and which has a distal wide surface 100B and a proximate wide surface 100C relative to the upper wall 16, and first and second end portions 11, 12 which are in line with and disposed at opposite ends of the middle portion 10A. The first and second end portions 11, 12 are bent to an acute angle α, β (see FIG. 3) relative to and toward the distal wide surface 100B of the middle portion 100A (see FIG. 3) along two parallel lines 100D, 100E which incline at a predetermined angle θ relative to a vertical line "L" that crosses a longitudinal direction of the middle portion 100A so as to form first and second anchoring surfaces 110, 120. The first and second anchoring surfaces 110, 120 respectively face two opposite inner surfaces of the skirt portion 15.

Each of the socket members 14 has a shell portion 14A to receive the bulb base 40B of one of the incandescent bulbs 40, and a seat portion 14B which extend from the shell portion 14A in an axial direction and which is disposed to abut against one of the first and second anchoring surfaces 110, 120 with the axial direction normal relative to the respective inner surface of the skirt portion 15.

Each of the insulated conductive cord members 18, 19 has one end portion connected conductively to the seat portion 14B of the socket member 14, and the other end portion led through the mounting hole 16A of the middle portion 100A and the through hole 16A of the upper wall 16 to form a first contact terminal 33. The first contact terminal 33 is disposed upwardly and outwardly relative to the lampshade body 1.

The containment member 2 is capable of housing electrical components that are associated with the electricity supply to the incandescent lighting arrangement, and includes an upper body 20 which has a circumferential wall 22 and an annular portion 21 extending downwardly from the circumferential wall 22 and of a dimension to shield the upper wall 16 when the containment member 2 is coupled with the upper wall 16 of the lampshade body 1. The power cord member includes first and second conductive cables 26, 27 which are adapted to be connected to a power supply and which are led downwardly and outwardly of the upper body 20 and into the annular portion 21 to form a second contact terminal 32 which is coupled electrically with the first contact terminal 33.

In the preferred embodiment, the cute angle α, β ranges between 38 to 52 degrees while the predetermined angle θ ranges between 16 to 26 degrees. The upper body 20 further includes a top mounting plate 22A formed with a communicating hole 25 for extension of the first and second conductive cables 26, 27 of the power cord member in order to form the second contact terminal 32. The hole 25 is offset relative to an axis of the through hole 16A of the upper wall 16 of the lampshade body 1.

Figure 5:
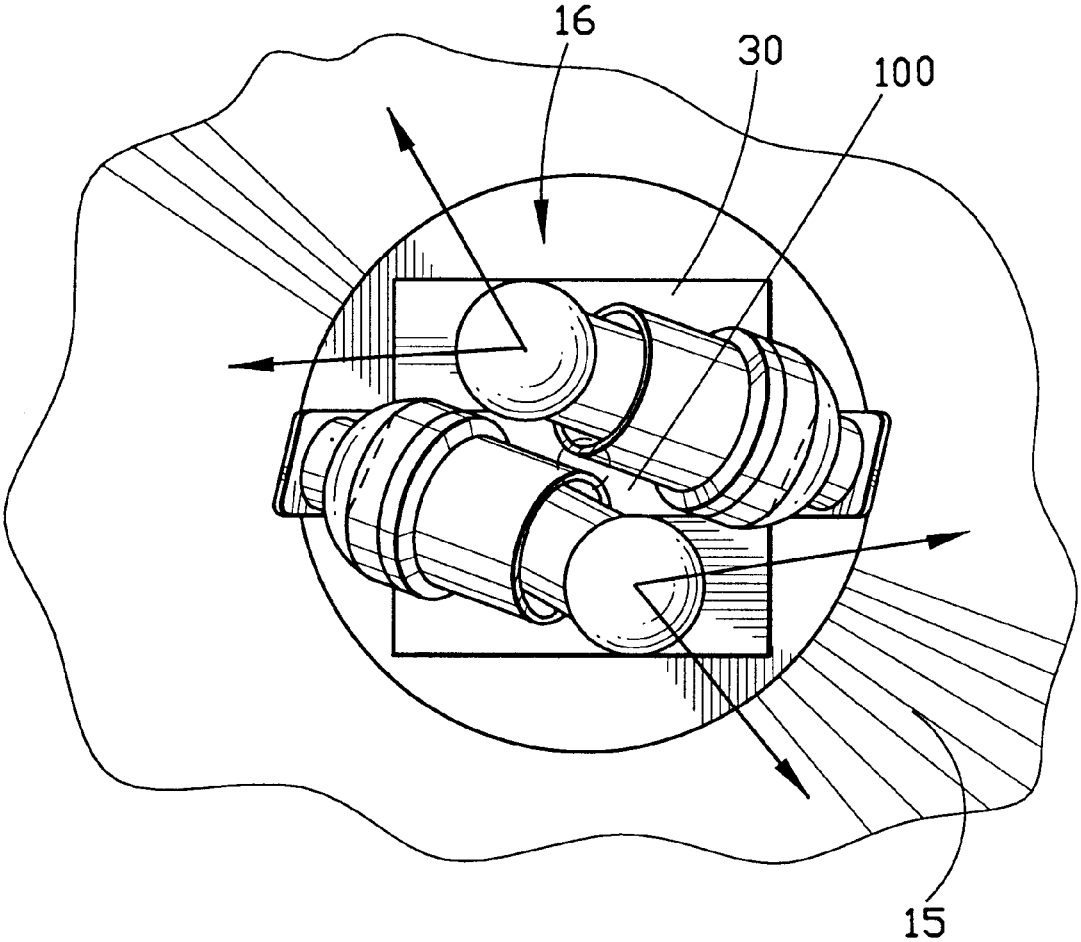
FIG. 5 is a fragmentary view of the preferred embodiment, illustrating the lighting arrangement of the incandescent bulbs.

Referring to FIG. 5, the preferred embodiment further includes a circular metal plate 30 configured to and interposed between the upper wall 16 of the lampshade body 1 and the mounting bracket 100 in order to dissipate the heat of lighting of the incandescent bulbs 40.

The first and second anchoring surfaces 110, 120 are provided with two through holes respectively for passage of the insulated conductive cord members 18, 19. The containment member 2 further has two diametrically disposed positioning studs 24 that project downwardly from the circumferential wall 22. The upper wall 16 of the lampshade body 1 is formed with two diametrically opposed holes 16B for extension of the studs 24. Two nut units are threaded on the studs 24 for securing the lampshade body 1 on the containment member 2.

As best shown in FIG. 2, due to the inclined arrangement of the anchoring surfaces 110, 120 relative to the middle portion 10A, the incandescent bulbs 40 mounted thereon cooperatively provide a lighting arrangement comparable to a halogen lamp which has the same wattage as that of the incandescent bulbs 40.

While the invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A lighting fitting for an incandescent lighting arrangement having a pair of incandescent bulbs, each of the incandescent bulbs including a bulb body and a bulb base, comprising:

a lampshade body formed from molding plastics, said lampshade body having an upper wall that defines a through hole in a center thereof, and a skirt portion that extends downwardly and divergently from the periphery confining said upper wall;

a mounting bracket including an elongate middle portion that defines a mounting hole aligned with said through hole, and that has a distal wide surface and a proximate wide surface relative to said upper wall, said mounting bracket further including first and second end portions in line with and disposed at opposite sides of said middle portion, said first and second end portions being bent to an acute angle relative to and toward said distal wide surface of said middle portion along a respective one of two parallel lines which incline at a predetermined angle relative to a vertical line that crosses a longitudinal direction of said middle portion so as to form a first anchoring surface and a second anchoring surface respectively facing two opposite inner surfaces of said skirt portion;

a pair of socket members adapted to receive the incandescent bulbs therein, each of said socket members having a shell portion adapted to receive the bulb base of one of the incandescent bulbs, and a seat portion which extends from said shell portion in an axial direction and which is disposed to abut against one of said first and said second anchoring surfaces with said axial direction normal relative to said respective anchoring surface;

a pair of insulated conductive cord members, each having one end portion connected conductively to said seat portion, and the other end portion led through said mounting hole as well as said through hole to of said upper wall of said lampshade body to form a first contact terminal which is disposed upwardly and outwardly relative to said lampshade body;

a containment member for housing electrical components associated with supply of electricity to the incandescent lighting arrangement, said containment member including an upper body having a circumferential wall and an annular portion extending downwardly from said circumferential wall and of a dimension to shield said upper wall when said containment member is coupled with and superimposed upon said upper wall of said lampshade body, said upper body being formed with a communicating hole; and a power cord member adapted to be connected to a power supply and led downwardly and outwardly of said upper body at said communicating hole and into said annular portion of said containment member to form a second contact terminal to couple electrically with said first contact terminal.

2. The lighting fitting as defined in claim 1, wherein said communicating hole of said upper body is offset relative to an axis of said through hole of said upper wall for extension of said power cord member in order to form said second contact terminal.

3. The lighting fitting as defined in claim 1, further comprising a metal plate interposed between said upper wall of the lampshade body and said mounting bracket in order to dissipate the heat of lighting of the incandescent bulbs.

4. The lighting fitting as defined in claim 1, wherein said acute angle ranges between 38 to 52 degrees.

5. The lighting fitting as defined in claim 1, wherein said predetermined angle ranges between 26 to 36 degrees.

* * * * *